US007303659B2

(12) United States Patent
Inagaki et al.

(10) Patent No.: US 7,303,659 B2
(45) Date of Patent: Dec. 4, 2007

(54) SYSTEM FOR PREVENTING ADHESION OF MARINE ORGANISMS

(75) Inventors: Shuichi Inagaki, Yokosuka (JP); Liang Yan, Yokohama (JP); Kenji Sato, Hiratsuka (JP); Akira Nemoto, Ota-Ku (JP); Yoshiharu Mikami, Yokohama (JP); Nobuo Yamaga, Nakano-Ku (JP); Tadahiko Oba, Adachi-Ku (JP); Makoto Gomi, Hiroshima (JP); Takeo Shimazaki, Souka (JP); Kouichi Furugaki, Yokohama (JP); Kenji Kaneda, Chiba (JP)

(73) Assignees: Kabushiki Kaisha Toshiba, Tokyo (JP); Tokyo Energy & Systems Inc., Tokyo-To (JP)

( * ) Notice: Subject to any disclaimer, the term of this patent is extended or adjusted under 35 U.S.C. 154(b) by 0 days.

(21) Appl. No.: 11/224,958

(22) Filed: Sep. 14, 2005

(65) Prior Publication Data

US 2006/0054498 A1 Mar. 16, 2006

(30) Foreign Application Priority Data

Sep. 15, 2004 (JP) ..... 2004-268741

(51) Int. Cl.
*C23F 13/00* (2006.01)

(52) U.S. Cl. ..... 204/196.37; 204/196.01; 204/196.19

(58) Field of Classification Search ..... 204/196.01, 204/196.19, 196.37
See application file for complete search history.

(56) References Cited

U.S. PATENT DOCUMENTS

| | | | | |
|---|---|---|---|---|
| 6,511,586 | B1 | 1/2003 | Nakashima et al. | |
| 6,579,429 | B2 * | 6/2003 | Inagaki et al. | 204/196.02 |

FOREIGN PATENT DOCUMENTS

| | | |
|---|---|---|
| JP | 7-300833 | 11/1995 |
| JP | 11-323868 | 11/1999 |
| JP | 2000-119884 | 4/2000 |

* cited by examiner

*Primary Examiner*—Bruce F. Bell
(74) *Attorney, Agent, or Firm*—Oblon, Spivak, McClelland, Maier & Neustadt, P.C.

(57) ABSTRACT

Plural composite panels are aligned in multiple horizontal rows. Each composite panel includes a titanium panel (anode), an electrical insulating member and a stainless-steel band member. The titanium panels (also, stainless-steel band members) of horizontally adjacent panels overlap each other to be in face-to-face contact. The stainless-steel band members are horizontally connected at different levels to form long negative electrodes (cathode) extending in seawater-flowing direction in an inlet channel. Each stainless-steel band member is exposed to seawater through a gap between vertically adjacent composite panels.

10 Claims, 4 Drawing Sheets

SYSTEM FOR PREVENTING ADHESION OF MARINE ORGANISMS

BACKGROUND OF THE INVENTION

1. Field of the Invention

The present invention relates to a technique for preventing adhesion of marine organisms to an inlet channel of a plant, by using electrolysis.

2. Description of the Related Art

Marine organisms, such as mussels, barnacles, hydrozoan and marine alga, adhere to water contact surfaces (inner surfaces) of an inlet channel of a power plant, which uses seawater as a cooling water. The adhering marine organisms reduce the seawater flow rate in the inlet channel, hindering the function of the inlet channel.

For the purpose of exterminating the marine organisms and preventing adhesion of the marine organisms, various measures are taken. Such measures include: pouring chlorine or a chlorine compound into environmental seawater; coating a paint containing a toxic ion generating pigment; and generating toxic ions, such as chlorine ions or copper ions, through the electrolysis of seawater.

Although these measures exercise effective antifouling functions, the management of the quantity and concentration of those chemicals is not simple when dealing with quantities of seawater and, therefore, the chemical concentration of seawater is liable to be excessively large. Consequently, it is highly possible that the chemicals cause environmental contamination. Thus, there is a trend in recent years to inhibit or control the use of the aforesaid methods.

Recently, non-pollutive and nontoxic antifouling measures have been developed. For example, antifouling silicone paints are nontoxic and do not cause environmental pollution. However, collision of shells and foreign substances with the silicone paints shortens the effective antifouling life of the silicone paints. Coating work using antifouling silicone paints requires a high cost. Antifouling silicone paints cannot be applied to structures having large surfaces and existing structures by simple, easy coating work. The antifouling effect of antifouling silicone paints is reduced in still seawater. Due to the above disadvantages, antifouling silicone paints have not been prevalently applied to practical uses.

JP11-323868A discloses a specific arrangement of electrodes for an electrochemical antifouling system. Insoluble conductive members are arranged on wall surfaces of an underwater structure, and are connected to a positive terminal of an external direct-current power source. When the insoluble conductive members are supplied with an antifouling current, they function as positive electrodes (anodes), so that chlorine and oxygen having sterilizing effect are generated at the interface between the insoluble conductive members and seawater. Thus, adhesion of marine organisms to the wall surfaces is prevented or suppressed.

JP2000-119884 (U.S. Pat. No. 6,511,586 B1) teaches that oxygen can be generated while suppressing the generation of chlorine, by using a positive electrode (anode) coated with an electric catalyst.

In the system of JP11-323868A, the negative electrodes (cathodes) are formed of metallic strips or metallic wires, and are formed in a shape resembling a lattice, a reed-screen, a net or a spiral. The negative electrodes are held in place by insulating support members, respectively, in such a manner that each of the negative electrodes is spaced apart from the corresponding positive electrode at the same distance.

However, with the arrangement of the negative electrodes of JP11-323868A, the costly, insulating support members are absolutely necessary, and considerable time and effort are necessary to install the system. Moreover, as the negative electrodes and the support members protrude into the interior of the channel, drifting articles such as garbage are likely to be caught by the negative electrodes and the support members.

JP7-300833A discloses an antifouling system provided with a negative electrode arranged on the bottom surface of the inlet channel. In this arrangement, wide anode potential distribution exists over the positive electrode, and the anode potential of a part of the positive electrode near the negative electrode exceeds the limit for oxygen generation (1.2 V S.C.E.) to reach the range for chlorine generation. Thus, this arrangement is not suitable for an antifouling method by using oxygen.

A system, which includes titanium sheets serving as anodes, and anchor bolts for fixing the titanium sheets in place and serving as cathodes, has been proposed. The anchor bolts are electrically insulated from the titanium sheet. With this arrangement, lead wires are connected to the anchor bolts, and thereafter, the titanium plate is fastened to the anchor bolts. Thus, the install work is troublesome.

Moreover, with the above arrangement, titanium plates are provided to supply anodic current to the titanium sheets. Thus, the number of the component parts is considerably large. In addition, as four anchor bolts are necessary to fix each titanium sheet, a considerably long time is required to install the system.

SUMMARY OF THE INVENTION

The present invention has been made in view of the aforementioned problems. The object of the present invention is to provide a system for preventing adhesion of marine organisms, which can be readily installed on an inner surface of an inlet channel at low cost, and which is capable of generating oxygen effectively.

In order to achieve the above objective, the present invention provides a system for preventing adhesion of marine organisms to a surface of an inlet channel. The system includes: an adhesion-preventing plate attached to the surface of the inlet channel, the plate including: an electrical insulator; an anode-forming sheet arranged on a front surface of the insulator; and a plurality of cathode-forming bands arranged on a back surface of the insulator while being separated from each other, each of the bands extending in a flow direction of water flowing through the channel; and a direct-current power source electrically connected to the anode-forming sheet and the cathode-forming bands.

The adhesion-preventing plate may be constituted by a plurality of composite panels, each including: a titanium panel serving as a part of the anode-forming sheet; an electrical insulating member arranged on a back surface of the titanium panel and serving as a part of the electrical insulator; and a stainless-steel band member arranged on a back surface of the electrical insulating member and serving as a part of one of the cathode-forming bands.

The present invention further provides a composite panel for preventing adhesion of marine organisms, which includes: a titanium panel having a main portion, an underlying portion, and an overlying portion to be placed on an underlying portion of another composite panel; an electrical insulating member arranged on a back surface of the titanium panel at the main portion and the underlying portion thereof; and a stainless-steel band member arranged, via the insulating element, on the back surface of the titanium panel, the band member extending along an edge of said composite panel and having a protruding portion extending over an edge of the titanium panel, and wherein said composite panel has a fixing portion at which said composite panel is fixed to a target object, and the insulating member comprises an electrical insulating resin material at the fixing portion, and comprises a foam material at a portion other than the fixing portion.

The present invention further provides a method of installing a system for preventing adhesion of marine organisms on an inner surface of an Inlet channel. The method includes: preparing a plurality of composite panels as mentioned above; placing one of the composite panels on the inner surface, while the titanium panel thereof faces the interior of the channel, and the stainless-steel band member thereof is located at a top of said one of the composite panels; repeating placing one of the composite panels, while the overlying portion of one of two neighboring composite panels with respect to a water-flowing direction in the inlet channel is placed on the underlying portion of the other of said two neighboring composite panels; and fixing said plurality of composite panels to the inner surface at the fixing portion thereof by means of fixing members, whereby the titanium panels of said plurality of composite panels are integrated to form a continuous titanium sheet, and the stainless-steel band members of said plurality of composite panels are integrated to form continuous stainless-steel bands each extending in the water-flowing direction on the back surfaces of the insulating members.

Uniform electrical potential distribution can be achieved, due to the provision of plural cathode-forming bands extending in water-flowing direction in the inlet channel. Thus, oxygen can be generated effectively while suppressing the generation of chlorine.

The system for preventing adhesion of marine organisms can be readily installed on the inlet channel at a low cost, due to the use of composite panels each including a titanium panel and a stainless-steel band member.

BRIEF DESRIPTION OF THE DRAWINGS

DETAILED DESCRIPTION OF THE PREFERRED EMBODIMENTS

Figure 1:
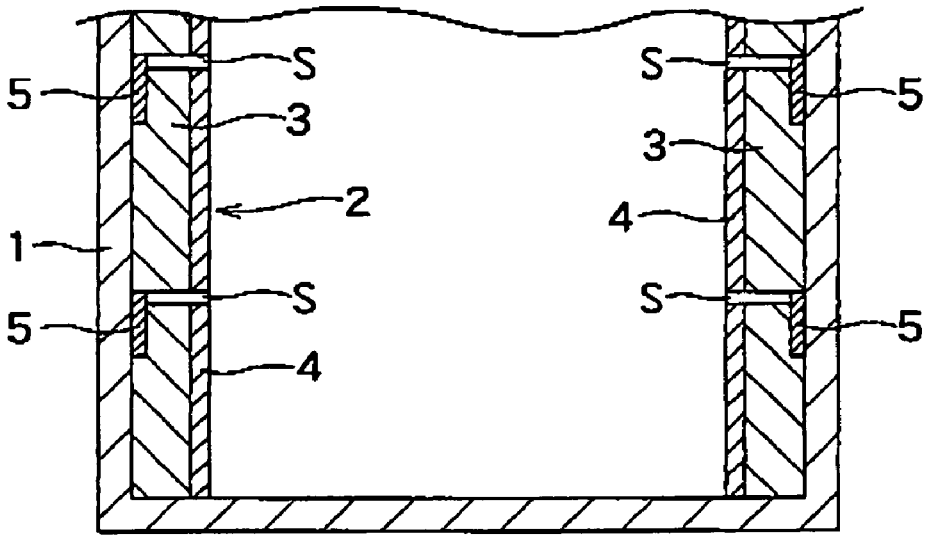
FIG. 1 is a vertical cross-sectional view of an inlet channel provided with a system for preventing adhesion of marine organisms according to the present invention.

FIG. 1 schematically shows the structure of the system for preventing adhesion of marine organisms. A marine-organisms adhesion-preventing plate 2 is attached to each of the inner side surfaces 1 of an inlet channel made of a concrete. The adhesion-preventing plate 2 is formed by attaching a titanium sheet 4 on the front surface of an electrical insulator (insulating layer) 3 and attaching a plurality of stainless-steel bands 5 on the back surface of the insulator 3. Each of the stainless-steel bands 5 is exposed to seawater in the inlet channel through an opening S formed in the insulator 3 and the titanium sheet 4. The titanium sheet 4 and the stainless-steel bands 5 are electrically connected to a dc (direct-current) power source, not shown.

Each of the stainless-steel bands 5 is formed of a long stainless-steel plates 6, and functions as a cathode, or a negative electrode. The width of the stainless-steel band 5 is preferably not more than 10 mm, which width is effective for preventing adhesion of marine organisms to the cathode portion if the current density is not less than 10 $A/m^2$. The vertical width of the part, exposed to seawater, of the stainless-steel band 5 is preferably 2 to 10 mm, which width is effective for achieving uniform anode electrical potential distribution where a plurality of stainless-steel bands 5 are arranged at vertical intervals and extend in seawater-flowing direction The titanium sheet 4 is preferably coated with an electrical catalyst (not shown), which is preferably selected from a single substance of a metal of platinum group, a single substance of a metal oxide of platinum group, and a mixed crystal substance thereof, or a complex substance thereof. A ruthenium catalyst is specifically preferable. The catalyst may be subjected to a thermal activation process that heats the catalyst at a temperature in the range of 350 to 450° C. for several hours by resistance heating. Oxygen can effectively be generated while suppressing generation of chlorine, by using the titanium sheet 4 coated with such a catalyst.

The insulator 3 on the back surface of the titanium sheet is composed of an electrical insulating resin material and a foam material, the former being arranged at portions (i.e., fixing portions) of the adhesion-preventing plate 2 at which the plate 2 is fixed to the inner surface 1 of the inlet channel, and the latter being arranged at the remaining portion(s) of the plate 2. The insulating resin material may be polyvinyl chloride. The use of the insulating resin material at the fixing portion achieves not only good insulating ability but also secure fastening of the plate 2. The use of the foam material at the remaining portion achieves not only good insulating ability but also reduction in the weight of the plate 2.

The titanium plate 4, the insulator 3 and the stainless-steel bands 5 are fixed at the fixing portions to the inner surface 1 of the concrete inlet channel by using fixing members. Preferably, each fixing member comprises a titanium anchor bolt, which is not dissolved in seawater.

Due to the above structure, the titanium sheet 4 serving as an anode-forming member and the stainless-steel bands 5 each serving as cathode forming members can be integrally fixed to the inner surface 1 of the inlet channel. Thus, the system for preventing adhesion of marine organisms can readily be installed at a low cost.

Figure 2:
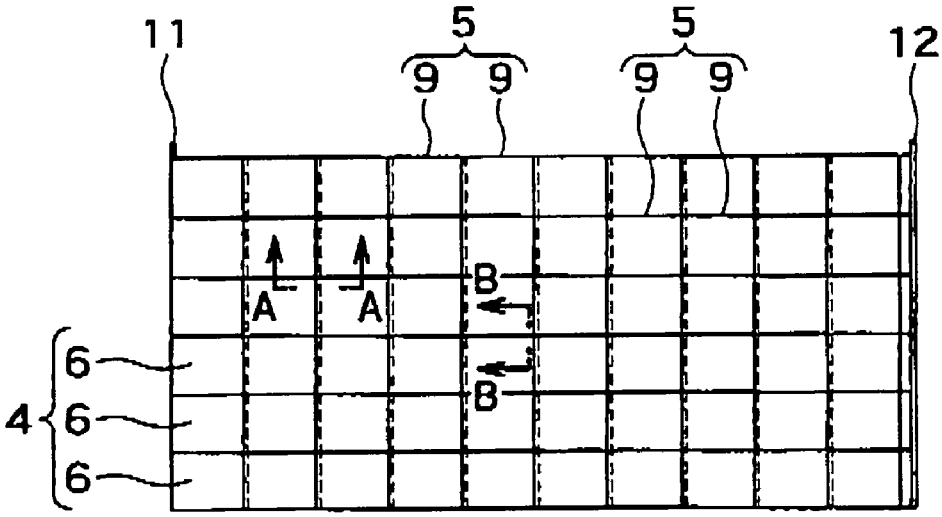
FIG. 2 is a front view of a marine-organisms adhesion-preventing plate composed of a plurality of composite panels.
Figure 3:
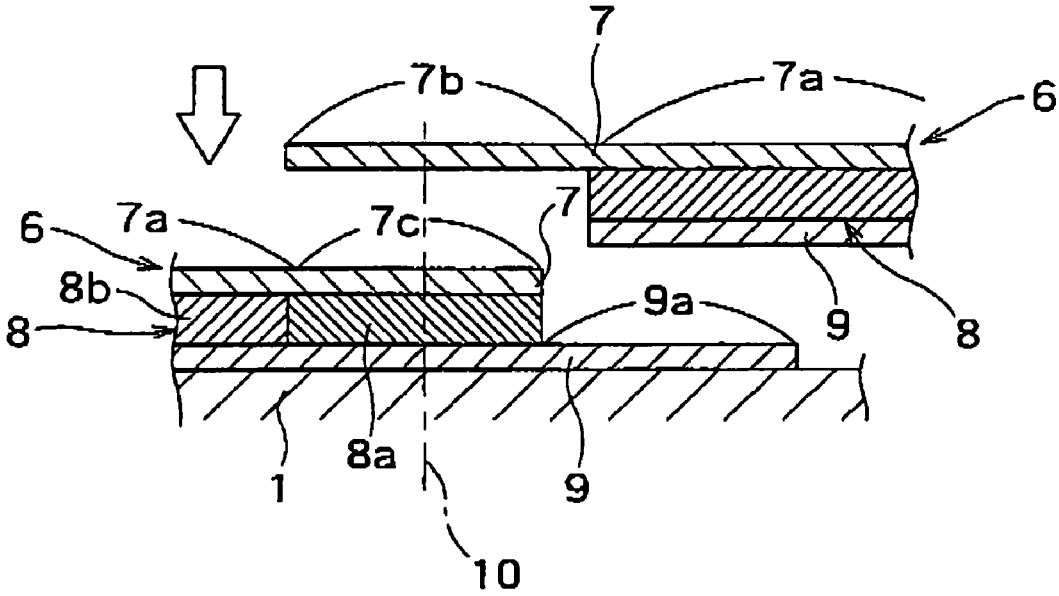
FIG. 3 is a cross-sectional view taken along line A-A in FIG. 2.
Figure 4:
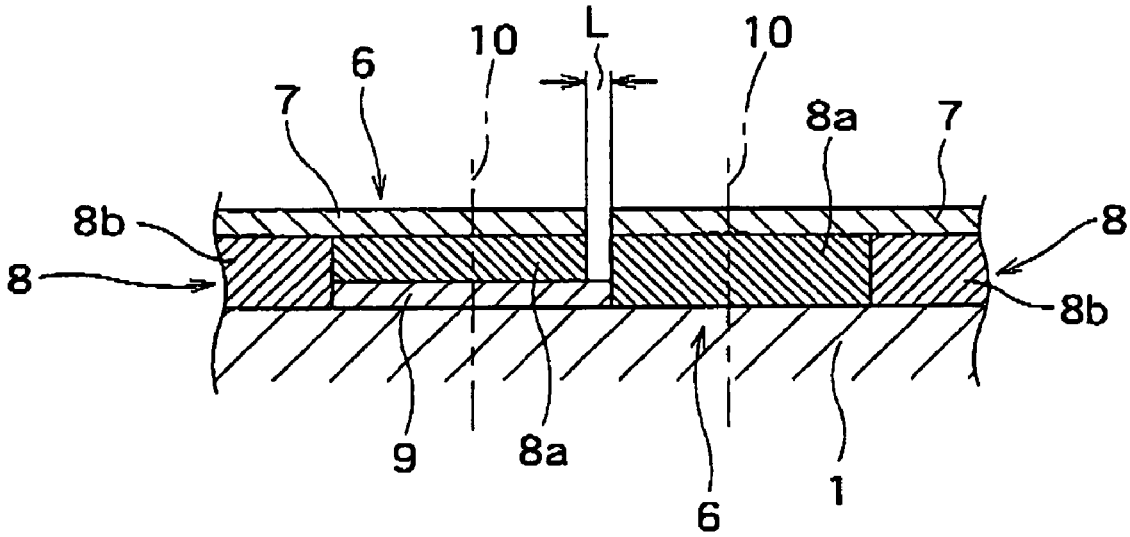
FIG. 4 is a cross-sectional view taken along line B-B in FIG. 2.
Figure 5:
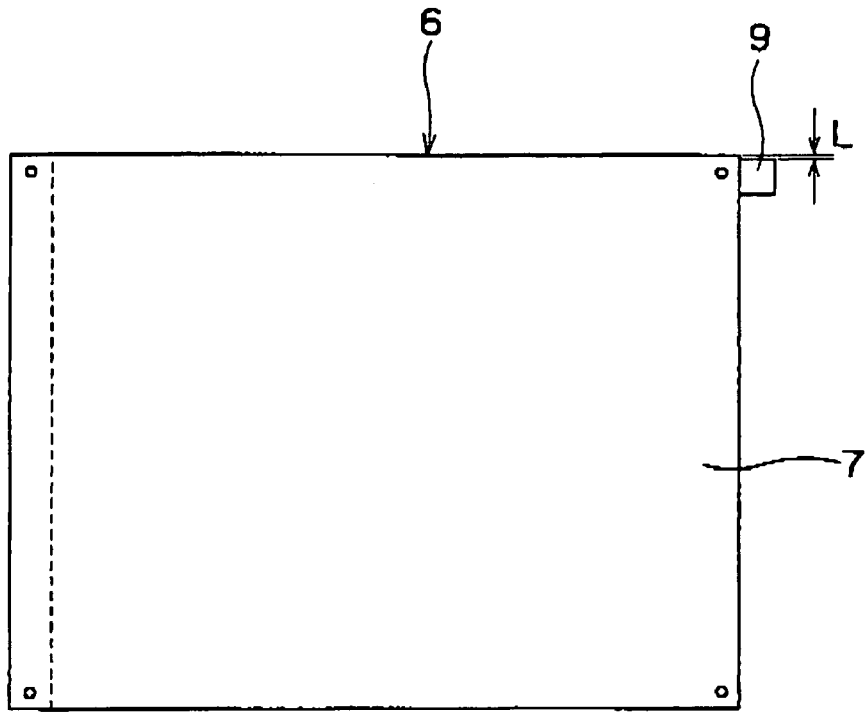
FIG. 5 is a front view of the composite panel shown in FIG. 2.
Figure 6:
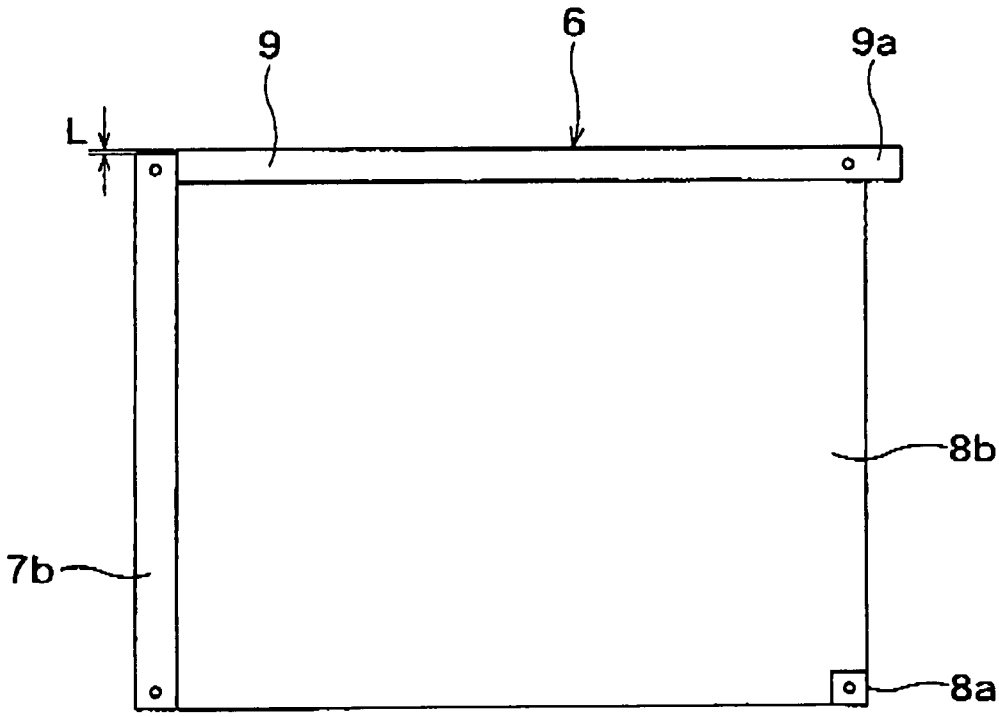
FIG. 6 is a back view of the composite panel shown in FIG. 2.

FIG. 2 is a front view of the marine-organisms adhesion-preventing plate 2 in another embodiment of the present invention. FIG. 3 is a cross-sectional view of the plate 2 taken along line A-A in FIG. 2. FIG. 4 is a cross-sectional view of the plate 2 taken along line B-B in FIG. 2. FIGS. 5 and 6 respectively show a front view and a back view of a composite panel for forming the marine-organisms adhesion-preventing plate 2.

The marine-organisms adhesion-preventing plate 2 of the system for preventing adhesion of marine organisms shown in FIGS. 2 to 6 is composed of a plurality of composite panels 6, which are fixed to and arrayed on the inner surface 1 of the inlet channel. Each of the composite panels 6 is composed of: a titanium panel 7 providing the front surface of the composite panel 6; an electrical insulating member 8 covering the back surface of the titanium panel 7; and a stainless-steel band member 9 formed of an elongated stainless-steel plate, arranged on the back surface of the insulating member 8, and extending along upper edge of the insulating member 8.

When the composite panels 6 are arrayed on the inner surface 1 of the inlet channel and are fixed thereto, the titanium panels 7 are integrated, and thus the aforementioned titanium sheet 4 is formed.

As shown In FIG. 3, the composite panel 6 is composed of the titanium panel 7, the insulating member 8 and the stainless-steel band member 9. The titanium panel 7 has a main portion 7*a*, an overlying portion 7*b* protruding laterally from a side edge of the composite panel 6 on one side (first side) thereof, and an underlying portion 7*c* on the other side (second side) the composite panel 6. The titanium panel 7 is also preferably coated with the aforementioned electrical catalyst.

The insulating member 8 is arranged on the back surfaces of the main portion 7*a* and the underlying portion 7*c* of the titanium panel 7. The stainless-steel band member 9 is arranged, via the insulating member 8, on the back surface of the titanium plate member 7 along the upper edge of the titanium panel 7. The stainless-steel band member 9 has a protruding portion 9*a* (see FIG. 3) protruding laterally from a side edge of the underlying portion 7*c* on one side (second side) of the composite panel 6. The upper edge portion of the stainless-steel member 9 protrudes upwardly from the upper edge of the titanium panel 7 at distance L (see FIGS. 4, 5 and 6). The Insulating member 8 is composed of: an electrical insulating resin material 8*a* disposed at fixing portions of the panel 6 at which the panel 6 is fixed to the inner surface of the inlet channel; and a foam material 8*b* arranged at the remaining portion of the panel 6. The fixing portions are areas where fixing members 10 are Inserted (see FIGS. 3 and 4), in other words, areas where fixing member insertion holes are arranged (four corners of the composite panel 6) (see FIGS. 5 and 6). Note that, the right side in FIG. 4 is the upper side, and FIG. 6 is mirror-reversed.

The titanium panel 7 (i.e., anode, or positive electrode), the insulating member 8, and the stainless-steel band member 9 (i.e., cathode, or negative electrode) is fixed to the inner surface 1 of the concrete inlet channel by means of the fixing members 10. Preferably, each fixing member 10 is a titanium anchor bolt, which is not dissolved in seawater. A nut or the like may be engaged with the anchor bolt. Preferably, a so-called "chemical anchor" (typically, resin adhesive) is used for fixing the titanium anchor bolt to the concrete inlet channel wall. The chemical anchor provides the root portion of the titanium anchor bolt with an electrical insulating layer, which insulates the stainless-steel band member 9 from the titanium anchor bolt and thus the titanium panel 7.

The titanium panels 7 are electrically connected to an external dc power source (not shown) through a titanium plate 11 (described later) serving as an anode-current feed line. The stainless-steel band members 9 are electrically connected to the dc power source through a stainless-steel plate 12 (described later) serving as a cathode-current line.

The method of installing the system for preventing adhesion of marine organisms employing the composite panels 6 will be described.

The first composite panel 6 is placed on the inner surface 1 of the inlet channel, with the titanium panel 7 facing the interior of the channel, and the stainless-steel band member 9 facing the inner surface 1 and being located at the top of the composite panel 6. The second composite panel 6 is placed next to the first composite panel 6 with respect to seawater-flowing direction in the inlet channel (i.e., horizontal direction), while the overlying portion 7*b* of the titanium panel 7 of the first composite panel 6 is placed on the underlying portion 7*c* of the titanium panel 7 of the second composite panel 6, and while the side edge portion of the stainless-steel band member 9 of the second composite panel 6 is placed on the protruding portion 9*a* of the stainless-steel band member 9 of the first composite panel 6 (see FIG. 3). The third composite panel 6 is arranged next to the second composite panel 6 in the same way. In this way, plural composite panels 6 are arrayed in plural horizontal rows at different levels (see FIG. 2).

The positional relationship between vertically adjacent composite panels 6 is shown in FIG. 4. The titanium panel 7 and the insulating member 8 (8*a*) of the upper composite panel 6 (right composite panel 6 in FIG. 4) are separated from those of the lower composite panel 6 (left composite panel 6 in FIG. 4) at distance L. Thus, the upper end portions of the stainless-steel band members 9 are exposed to seawater through the horizontally-extending gap (which corresponds to the opening S in FIG. 1) having vertical width L formed between the vertically adjacent rows of the composite panels 6.

Then, the composite panels 6 are fixed to the concrete inner surface 1 to the inlet channel at the fixing portions thereof by the fixing members 10 such as titanium anchor bolts. Thus, the titanium panels 7 of the composite panels 6 are integrated so that a continuous titanium sheet 4 is formed, and the stainless-steel band members 9 are integrated so that plural long stainless-steel bands 5 extending in seawater-flowing direction at different levels are formed on the back surfaces of the insulator 3.

In each of the composite panels 6, the titanium panel 7 and the elongated stainless-steel band member 9 are integrated. Thus, the titanium sheet 4 (i.e., anode, or positive electrode) and the stainless-steel bands 5 (i.e., cathode, or negative electrode) can be installed simultaneously, saving the man-hour requirement.

As adjacent titanium panels 7 (also, adjacent stainless-steel band members 9) are in face-to-face contact at the overlying and underlying portions (protruding portion) thereof, a stable electrical connection is established therebetween. As two adjacent composite panels 6 are fixed to the inner surface 1 to the inlet channel where the overlying portion 7*b* of one composite panel 6 is placed on the underlying portion 7*c* of the other panel 6 by common fixing means (anchor bolts), the number of anchor bolts can be reduced.

Figure 7:
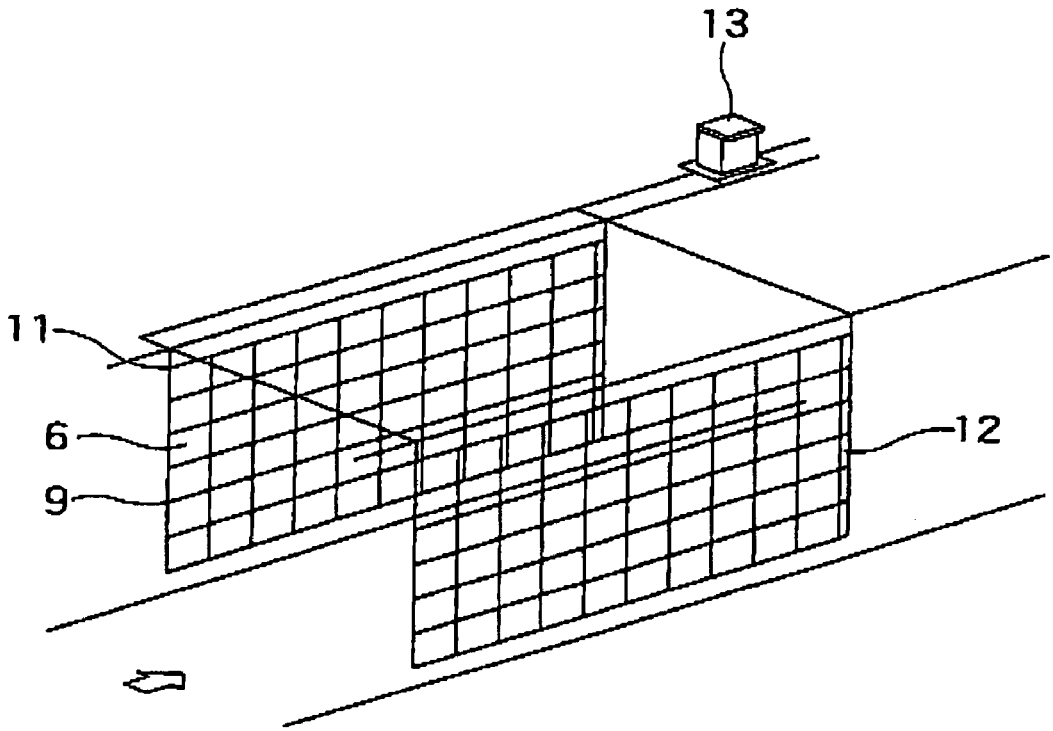
FIG. 7 is a schematic perspective view of a concrete inlet channel provided with the system for preventing adhesion of marine organisms according to the present invention.

FIG. 7 is a schematic perspective view of an inlet channel of a box-culvert type equipped with the system for preventing adhesion of marine organisms according to the present invention.

The inner side surfaces of the inlet channel are covered with the composite panels 6, and thus the titanium sheet 4 and the stainless-steel bands 5 are arranged on each of the side surfaces of the inlet channel. A dc power source 13 is electrically connected to the titanium plate 4 through the titanium plate 11 serving as an anode-current feed line, and to the stainless-steel bands 5 through the stainless-steel plate 12 serving as an cathode-current line.

It was confirmed, in operation, that adhesion of marine organisms can be effectively prevented, by applying electrolysis to seawater to generate oxygen, while maintaining the anode potential (the potential of the titanium sheet 4 coated with catalyst) at 0.52 to 1.20 V (cathode current density is not less than 10 $A/m^2$).

The invention claimed is:

1. A system for preventing adhesion of marine organisms to a surface of an inlet channel, said system comprising:

an adhesion-preventing plate attached to the surface of the inlet channel, the plate including:

an electrical insulator;

an anode-forming sheet arranged on a front surface of the insulator; and a plurality of cathode-forming bands arranged on a back surface of the insulator, each of the bands extending in parallel with the anode-forming sheet, extending in a flow direction of water flowing through the channel, and being separated from an adjacent cathode-forming band; and a direct-current power source electrically connected to the anode-forming sheet and the cathode-forming bands.

2. The system according to claim 1, wherein the adhesion-preventing plate comprises a plurality of composite panels, each including:

a titanium panel serving as a part of the anode-forming sheet;

an electrical insulating member arranged on a back surface of the titanium panel and serving as a part of the electrical insulator; and a stainless-steel band member arranged on a back surface of the electrical insulating member and serving as a part of one of the cathode-forming bands.

3. The system according to claim 2, wherein each of the composite panels is fixed to the surface of the inlet channel at a fixing portion of the composite panel, the insulating member of the composite panel at the fixing portion comprises an electrical insulating resin material, the insulating member of the composite panel at a portion other than the fixing portion comprises a foam material, and the titanium panel, the stainless-steel band and the resin material are fixed together to the surface of the inlet channel at the fixing portion by a fixing member.

4. The system according to claim 3, wherein the fixing member comprises a titanium anchor bolt.

5. The system according to claim 3, the stainless-steel band member has a vertical width not greater than 10 mm.

6. The system according to claim 2, wherein the stainless-steel band member extends along an edge of the composite panel and has a protruding portion extending over an edge of the titanium panel.

7. The system according to claim 1, wherein a front surface of the titanium panel is coated with an electrical catalyst.

8. The system according to claim 7, wherein the electrical catalyst is selected from a single substance of a metal of platinum group, a single substance of a metal oxide of platinum group, and a mixed crystal substance thereof, or a complex substance thereof.

9. A composite panel for preventing adhesion of marine organisms, comprising:

a titanium panel having a main portion, an underlying portion, and an overlying portion to be placed on an underlying portion of another composite panel;

an electrical insulating member arranged on a back surface of the titanium panel at the main portion and the underlying portion thereof; and a stainless-steel band member arranged, via the insulating member, on the back surface of the titanium panel, the band member extending along an edge of said composite panel and having a protruding portion extending over an edge of the titanium panel, and wherein said composite panel has a fixing portion at which said composite panel is fixed to a target object, and the insulating member comprises an electrical insulating resin material at the fixing portion, and comprises a foam material at a portion other than the fixing portion.

10. A method of installing a system for preventing adhesion of marine organisms on an inner surface of an inlet channel, said method comprising:

preparing a plurality of composite panels as defined in claim 8;

placing one of the composite panels on the inner surface, while the titanium panel thereof faces the interior of the channel, and the stainless-steel band member thereof is located at a top of said one of the composite panels;

repeating placing one of the composite panels, while the overlying portion of one of two neighboring composite panels with respect to a water-flowing direction in the inlet channel is placed on the underlying portion of the other of said two neighboring composite panels; and fixing said plurality of composite panels to the inner surface at the fixing portion thereof by fixing members, whereby the titanium panels of said plurality of composite panels are integrated to form a continuous titanium sheet, and the stainless-steel band members of said plurality of composite panels are integrated to form continuous stainless-steel bands each extending in the water-flowing direction on the back surfaces of the insulating members.

* * * * *